US008387534B1

(12) United States Patent
Imholt

(10) Patent No.: US 8,387,534 B1
(45) Date of Patent: Mar. 5, 2013

(54) DETONATION DEVICE COMPRISING NANOCOMPOSITE EXPLOSIVE MATERIAL

(75) Inventor: Timothy J. Imholt, Richardson, TX (US)

(73) Assignee: Raytheon Company, Waltham, MA (US)

( * ) Notice: Subject to any disclaimer, the term of this patent is extended or adjusted under 35 U.S.C. 154(b) by 1189 days.

(21) Appl. No.: 12/244,095

(22) Filed: Oct. 2, 2008

Related U.S. Application Data

(60) Provisional application No. 60/977,226, filed on Oct. 3, 2007.

(51) Int. Cl.
*F41A 19/63* (2006.01)
*F42D 1/045* (2006.01)

(52) U.S. Cl. ..... 102/275.11; 102/200

(58) Field of Classification Search ..... 102/200, 102/205, 207, 214, 275.11
See application file for complete search history.

(56) References Cited

U.S. PATENT DOCUMENTS

| | | | | |
|---|---|---|---|---|
| 5,088,411 | A * | 2/1992 | Kurokawa et al. | 102/200 |
| 5,505,134 | A * | 4/1996 | Brooks et al. | 102/202.7 |
| 7,927,439 | B1 * | 4/2011 | Forbes et al. | 149/109.4 |
| 2003/0019386 | A1 * | 1/2003 | Lloyd et al. | 102/494 |
| 2004/0060626 | A1 * | 4/2004 | Tillotson et al. | 149/19.92 |
| 2005/0007001 | A1 * | 1/2005 | Imholt et al. | 313/231.31 |
| 2006/0011083 | A1 * | 1/2006 | Perry et al. | 102/205 |

OTHER PUBLICATIONS

U.S. Appl. No. 11/830,938 entitled, "Aligning Nanomaterial in a Nanomaterial Composite," filed Jul. 31, 2007, 26 pages.
U.S. Appl. No. 11/830,970 entitled, "Making a Nanomaterial Composite," filed Jul. 31, 2007, 28 pages.

* cited by examiner

*Primary Examiner* — Bret Hayes
(74) *Attorney, Agent, or Firm* — Renner, Otto, Boisselle & Sklar, LLP

(57) ABSTRACT

According to one embodiment, a system comprises a composite and an applicator. The composite comprises an explosive material and a plurality of nanostructures. The applicator is configured to direct microwaves to the composite. In response to the microwaves, the nanostructures within the composite generate shockwaves that detonate the explosive material.

24 Claims, 2 Drawing Sheets

CLUMPED NANOMATERIALS

DISPERSED AND ALIGNED NANOMATERIALS

DETONATION DEVICE COMPRISING NANOCOMPOSITE EXPLOSIVE MATERIAL

RELATED APPLICATIONS

This application claims priority under 35 U.S.C. §119 of provisional application Ser. No. 60/977,226, filed Oct. 3, 2007, entitled, "Detonation Device Comprising Nanocomposite Explosive Material," which is hereby incorporated by reference.

TECHNICAL FIELD

This present disclosure relates generally to detonation devices and more particularly to a detonation device comprising nanocomposite explosive material.

BACKGROUND

The implosion of a structure generally involves multiple carefully timed explosions around the perimeter of the structure. These explosions are generally timed by timing circuits. These timing circuits, however, may be costly and unreliable.

SUMMARY

According to one embodiment, a system comprises a composite and an applicator. The composite comprises an explosive material and a plurality of nanostructures. The applicator is configured to direct microwaves to the composite. In response to the microwaves, the nanostructures within the composite generate shockwaves that detonate the explosive material.

Various embodiments of the explosion system may benefit from numerous advantages. It should be noted that one or more embodiments may benefit from some, none, or all of the advantages discussed below. One advantage is that nanostructures may react to a microwave field substantially simultaneously and thus may reduce or eliminate the need for costly and/or complex timing circuits in explosion systems.

DETAILED DESCRIPTION

Embodiments of the present invention and its advantages are best understood by referring to FIGS. 1 through 4 of the drawings, like numerals being used for like and corresponding parts of the various drawings.

Figure 1:
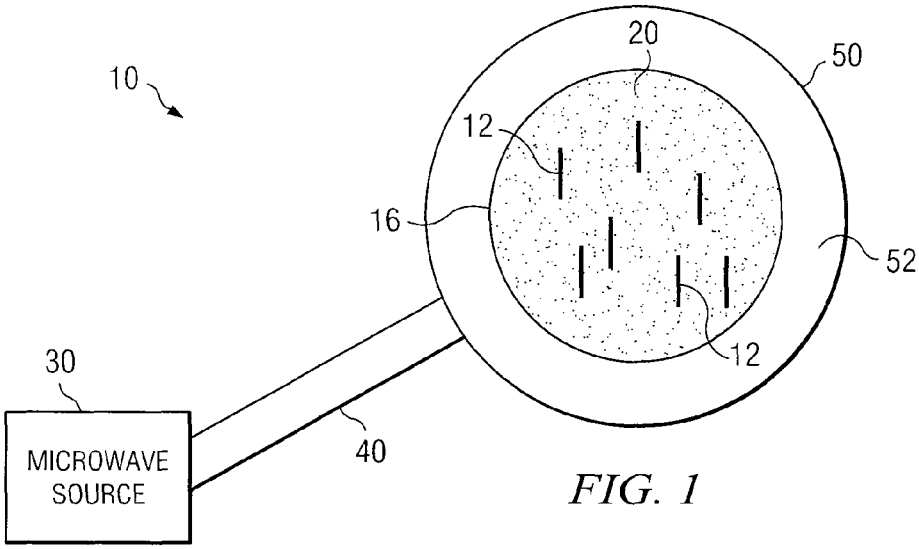
FIG. 1 illustrates an example of an explosion system.

FIG. 1 illustrates an explosion system 10, according to certain embodiments. In some embodiments, explosion system 10 may, without a timing circuit, uniformly detonate explosive material 20. Explosion system 10 may comprise a composite 16, a microwave source 30, one or more waveguides 40, and a microwave applicator 50 coupled as shown. The composite 16 may comprise an explosive material 20 and nanotubes 12.

In operation, the interaction between nanotubes 12 and microwaves detonates explosive material 20. In particular, microwave source 30 may generate microwaves. Waveguide 40 may then direct microwaves from microwave source 30 to microwave applicator 50. In some embodiments, microwave applicator 50 transmits a microwave field through composite 16, which may be an explosive material 20 impregnated with nanotubes 12. In response to the microwave field, nanotubes 12 may heat up rapidly and produce a shockwave that triggers an explosion of explosive material 20.

In one embodiment, microwave applicator 50 transmits microwaves, which travel at the speed of light, to composite 16, which includes nanotubes 12 dispersed throughout explosive material 20. As a result, nanotubes 12 within composite 16 may be exposed to and then react to the microwaves at substantially the same time. The reaction may cause the substantially simultaneous detonation of multiple regions of explosive material 20. An advantage of the substantially simultaneous detonation of multiple regions of explosive material 20 is that it may result in a more powerful and/or efficient explosion.

In FIG. 1, microwave source 30 may be any suitable source of microwaves. The term "microwave" in this disclosure refers to any suitable form of electromagnetic (EM) radiation in the radio frequency (RF) and/or microwave range, that is, approximately 5 kHz to 1,000 GHz. It should be understood, however, that the boundaries on either side of this range are not rigid definitions but rather general values. Microwave source 30 may comprise field effect transistors, bipolar junction transistors, Gunn diodes, klystrons, magnetrons, backward wave oscillators, and/or any suitable device that generates microwaves.

Microwave source 30 may be coupled to waveguide 40. Waveguide 40 may be any suitable structure that guides microwaves from microwave source 30 to microwave applicator 50. Waveguide 40 may be an EM waveguide such as, for example, a dielectric waveguide, a Goubau line, a hollow metallic waveguide, and/or any suitable waveguide. In some embodiments, waveguide 40 may be an optical waveguide.

Waveguide 40 may direct microwaves from microwave source 30 to microwave applicator 50. Microwave applicator 50 may comprise any suitable device that applies and/or directs microwaves and/or a microwave field to composite 16. In certain embodiments, microwave applicator 50 may be coupled to or integrated with a housing 52 that holds or contains composite 16. Microwave applicator 50 may comprise one or more probes, coaxial monopole applicators, and/or dielectric resonators. In some embodiments, microwave applicator 50 may comprise a chamber through which a microwave field is transmitted. In some embodiments, microwave applicator 50 may substantially surround composite 16. For example, the applicator 50 may be configured to substantially fit around the shape of composite 16. In one embodiment, composite 16 may be shaped like a cylinder, and applicator 50 may be shaped like a pipe that fits around the cylinder. In another embodiment, composite 16 may be shaped like a sphere, and applicator 50 may be shaped like a hollowed sphere that fits around the composite sphere. In another embodiment, composite 16 may be shaped like a box, and applicator 50 may be shaped like a hollowed box that fits around the composite box. Any other shape may be used for composite 16 and substantially duplicated with applicator 50.

Composite 16 may receive microwaves from microwave applicator 50. Composite 16 is made from two or more component materials with different sets of properties. The materials, when mixed together, remain identifiably separate and distinct. Post mixing, composite 16 possesses properties of each component material. Typically, the material that comprises the majority of a composite is referred to as matrix, and the other material is referred to as reinforcement. According to some embodiments, explosive material 20 forms the matrix and nanotubes 12 form the reinforcement of composite 16. In some embodiments, composite 16 may comprise 0.1 to 3 percent nanotubes 12, and the rest explosive material 20. Explosive material 20 may be a chemically or energetically unstable material that produces an explosion in response to a heat source, energy source, or other triggering event. An explosion may comprise a release of mechanical, chemical, and/or nuclear energy in a sudden and/or violent manner. In some embodiments, an explosion produces high temperatures, significant changes in pressure, and/or the release of gases. Explosive material 20 may be any suitable material or combination of materials such as, for example, amatol, baratol, octol, torpex, TNT, tetrytol, plutonium, uranium, and/or any suitable explosive material 20.

In some embodiments, explosive material 20 may be coupled to and/or impregnated with a plurality of nanotubes 12 to form composite 16. Generally, nanotubes 12 may interact with microwaves or other EM radiation to trigger an explosion of explosive material 20. Nanotubes 12 in explosion system 10 are a type of nanostructure. A nanostructure has a physical size that, in at least one dimension, is in the range of 0.1 to 100 nanometers. As long as at least one dimension of a given structure falls within this nanoscale range, the structure may be considered a nanostructure. In some embodiments, a nanostructure may exhibit one or more properties that a larger structure (even a larger structure made from the same atomic species) does not exhibit. Nanostructures may have various shapes and may comprise various materials.

Nanotube 12 is a type of nanostructure that has the shape of a cylinder or multiple concentric cylinders. In some embodiments, nanotubes 12 are synthesized from inorganic materials such as, for example, boron nitride, silicon, titanium dioxide, tungsten disulphide, and molybdenum disulphide. In other embodiments, nanotubes 12 are made of carbon. Nanotubes 12 may be synthesized by various techniques such as, for example, arc discharge, laser ablation, high pressure carbon monoxide (HiPCO), and chemical vapor deposition (CVD).

Nanotubes 12 possess various properties that may be illustrated by a discussion of carbon nanotubes 12. It should be understood, however, that explosive material 20 may be coupled to and/or impregnated with any suitable type of nanotubes 12. Carbon nanotubes 12 may be single walled or multi-walled. A single walled nanotube (SWNT) may comprise a one-atom thick sheet of electrically conductive graphite (referred to as graphene) that is rolled into a cylinder. The diameter of the cylinder is generally less than 100 nanometers. In some embodiments, the diameter of the cylinder is between one and two nanometers. The tube length of a SWNT may be many times longer (e.g., thousands of times longer) than the diameter of the SWNT. Accordingly, a SWNT may have a large aspect ratio (e.g., the length to diameter ratio may exceed 10,000). The ends of a carbon nanotube 12 (i.e., the ends of the cylindrical structure) may be capped with hemispherical structures. Thus, a carbon nanotube 12 may be a capped pipe.

A multi-walled nanotube (MWNT) is a multiple layered structure of tubes nested within one another. The number of layers may range from two to more than ten. The interlayer distance may be similar to the distance between graphene layers in graphite (e.g., approximately 3.3 angstroms). A multi-walled carbon nanotube 12 may exhibit electrical conductivity that is similar to that of graphene.

Nanotubes 12 may exhibit various properties. For example, nanotubes 12 absorb EM radiation and/or may act as an electrical conductor or semiconductor. According to certain embodiments, nanotubes 12 may heat up quickly when impacted by microwaves. In particular, nanotubes 12 may act as conductors and, in the presence of a microwave field, nanotubes 12 may rapidly increase in temperature. This increase in temperature may be due at least in part to dipole moments of nanotubes 12. Nanotubes 12 may have induced and/or permanent dipole moments, which may allow nanotubes 12 to absorb microwaves through resonances that occur in the microwave region. In some embodiments, bond vibrations may contribute to the increase in temperature of nanotubes 12. In particular, a microwave field may cause the molecular bonds in nanotube 12 to vibrate, which causes nanotube 12 to heat up.

In some embodiments, the absorption rate of nanotubes 12 to radiation in the microwave range is very high. This high rate of absorption generally causes nanotubes 12 in a microwave field to heat up rapidly and to produce a shockwave. This shockwave may cause explosive material 20 to explode. If explosive material 20 is impregnated with nanotubes 12, the explosion may be triggered substantially simultaneously in multiple regions of explosive material 20. The substantially simultaneous detonation of multiple regions of explosive material 20 may result in a more powerful and/or efficient explosion.

According to certain embodiments, explosion system 10 may be operable to cause an implosion of a structure. An implosion may comprise the concentration of matter and/or energy such that a structure collapses in on itself. In some embodiments, a structure may be imploded by causing multiple explosions around the perimeter of the structure. The interaction of microwaves and nanotubes 12 may facilitate multiple simultaneous explosions.

In some embodiments, nanotubes 12 may boost nuclear reactions. Nuclear reactions may depend on carefully timed implosions and/or explosions. In particular, timed implosions and/or explosions may be required to start a chain reaction in a nuclear weapon and/or to start a fission or fusion reaction. In some embodiments, nanotubes 12 may be used in fusion devices to generate additional neutrons for "boosting" the reaction. According to the embodiments, various gases may be confined within nanotubes 12. The types of gases confined within nanotubes 12 may be selected based on their tendency to make the reaction more volatile. For example, hydrogen, nitrogen, or oxygen may be selected. Nanotubes 12 are then irradiated with microwaves which may cause atoms to fuse.

In some embodiments, explosive material 20 impregnated with nanotubes 12 may be used in an explosively pumped flux compression generator (EPFCG). An EPFCG generally refers to a device that generates a high-power EM pulse by compressing magnetic flux using explosive material 20. If explosive material 20 is impregnated with nanotubes 12, the detonation of explosive material 20 may occur more rapidly. The more rapid explosion may yield a stronger EM pulse and may reduce side effects associated with a magnetic field produced as part of the explosion.

Figure 2:
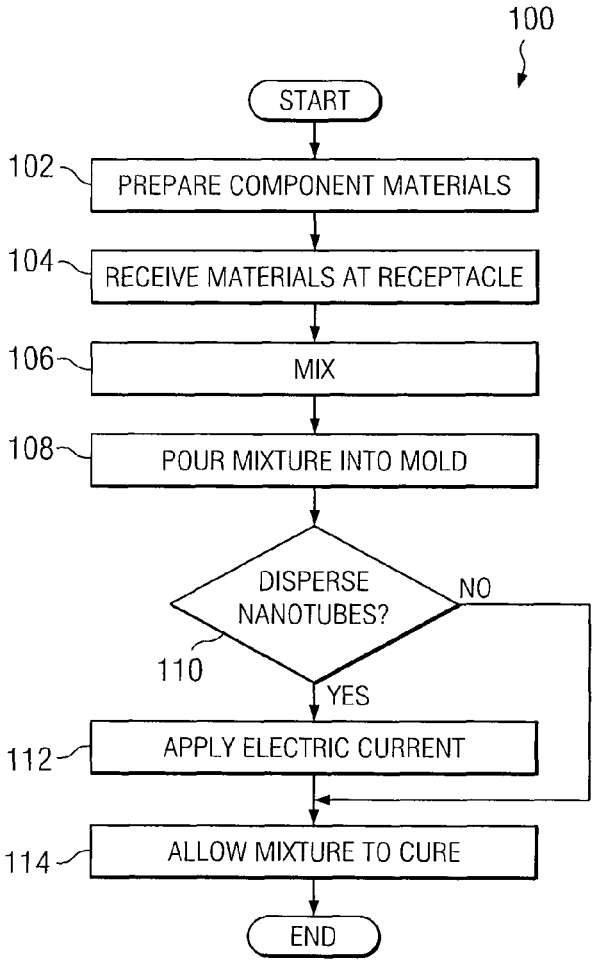
FIG. 2 is a flow diagram illustrating an example method for making a composite material.

FIG. 2 is a flow diagram illustrating an example method 100 for making composite 16. In step 102, the component materials are prepared. Component materials include components of the composite material, such as the nanomaterial, matrix, or other material, and may be in non-solid or uncured form. In some embodiments, component materials may include explosive material 20 and nanotubes 12.

Preparation of the component materials may include selecting the materials to be used. For example, explosive material 20 may be selected from the group consisting of amatol, baratol, octol, torpex, TNT, tetrytol, plutonium, uranium, and/or any suitable explosive material 20. Nanotubes 12 may be selected based on the various properties that may be desirable for the application such as, for example, strength, stiffness, ability to absorb EM radiation, and/or electrical conductivity or semi conductivity. In some embodiments, the quantity of explosive material 20 may be significantly greater than the quantity of nanotubes 12.

Figure 3A:
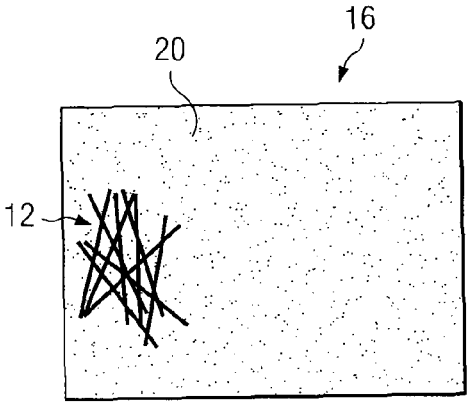
FIG. 3A illustrates an example of composite material with clumped nanomaterial.

According to some embodiments, preparation step 102 may include pretreatment of nanontubes 12 to reduce clumping of nanotubes 12. The molecules in nanotubes 12 are bound together by strong forces that may cause nanotubes 12 to clump together, as shown in FIG. 3A. Pretreatment with a liquid such as water, especially ionized water, may reduce the likelihood that the nanotubes 12 will clump together in the same region of composite 16. In one embodiment, nanotubes 12 may be submerged in the water and then the water containing the nanotubes 12 may be evaporated. This process may cause nanotubes 12 to absorb oxygen and hydrogen atoms from the evaporated water. The oxygen and hydrogen in nanotubes 12 may increase the mobility of nanotubes during application of an electric current, as described below in the discussion of FIG. 3B and FIG. 4, and may thereby reduce the likelihood of clumping.

Referring back to FIG. 2, at step 104, a receptacle receives component material and any material added to the component material during the making of composite 16. The material may be mixed in the receptacle at step 106. Once the material is mixed, it may be poured into a mold at step 108. For example, the mold may be a type of receptacle that forms composite material into any suitable size, shape (for example, rectangular, square, or round), or thickness.

Figure 3B:
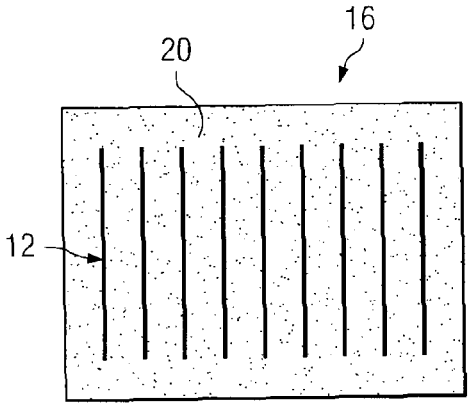
FIG. 3B illustrates an example of composite material with dispersed and aligned nanomaterial.

At step 110, a decision is made whether to disperse nanotubes 12 throughout composite 16 as shown in FIG. 3B. Dispersion measures the uniformity of a reinforcement (for example, nanotubes 12) in a matrix per unit volume. Composite 16 will possess more uniform properties throughout if it is more uniformly mixed. Non-uniform regions of composite 16 typically behave differently from one another. For example, if nanotubes 12 are unevenly dispersed in explosive material 20, different regions of composite 16 may behave differently when exposed to microwaves. This difference may reduce the likelihood of detonating explosive material 20 substantially simultaneously throughout composite 16.

Referring back to FIG. 2 at step 112, in some embodiments, an electric current may be applied to uncured composite 16 to create an electric field to disperse nanotubes 12 throughout composite 16. In some embodiments, the electric current may be applied in a non-oxidizing environment or other suitable environment that reduces the likelihood of a reaction. An example of a system for dispersing material is described with reference to FIG. 4.

Figure 4:
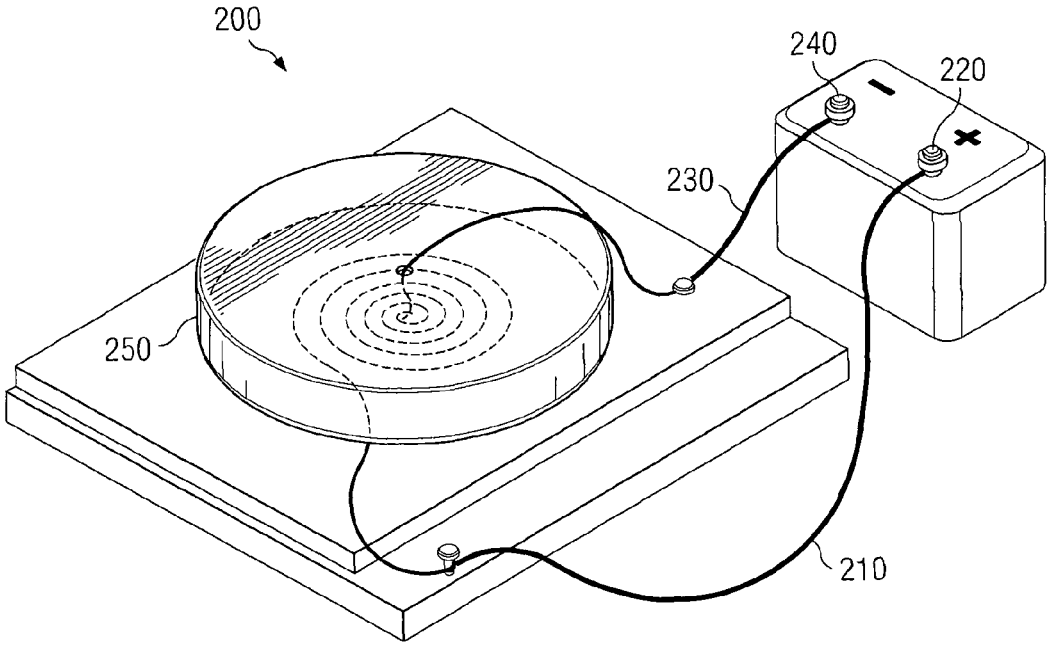
FIG. 4 illustrates a system for dispersing nanotubes throughout a composite material, according to certain embodiments.

FIG. 4 illustrates a system 200 for applying an electric current to uncured composite 16. In some embodiments, a conductive strip 210 coupled to positive lead 220 surrounds mold 250. A conductor 230 coupled to negative lead 240 penetrates mold 250 at substantially the center of mold 250. Electric current is passed uniformly through composite 16 as explosive material 20 cures to disperse nanotubes 12 in explosive material 20. Nanotubes 12 conduct electricity and in some cases build up a capacitance, and disperse and align along the electric field lines. In general, the more uniform the electric field, the better the dispersion alignment. The electric field holds nanotubes 12 in a dispersed position that prevents re-clumping. The current may be applied for any suitable duration. In one embodiment, the duration may be determined in accordance with the curing time of the matrix. For example, current may be applied when the matrix starts to cure until when the matrix is substantially cured.

Referring back to FIG. 2, the mixture is allowed to cure in step 114. The mixture may be allowed to cure for 1 to 36 hours.

Although the present invention has been described in several embodiments, a myriad of changes and modifications may be suggested to one skilled in the art, and it is intended that the present invention encompass such changes and modifications as fall within the scope of the present appended claims.

What is claimed is:

1. A system comprising:

a composite, the composite comprising an explosive material and a plurality of nanostructures substantially aligned and substantially dispersed throughout the composite; and an applicator configured to:

receive a plurality of microwaves; and direct the plurality of microwaves to the composite;

in response to the plurality of microwaves, the plurality of nanostructures are configured to interact with the plurality of microwaves to generate at least one shockwave that detonates the explosive material.

2. The system of claim 1:

the plurality of nanostructures making up 0.1 to 3 percent of the composite; and the explosive material making up substantially the rest of the composite.

3. The system of claim 1, the plurality of nanostructures substantially uniformly dispersed throughout the composite.

4. The system of claim 1, the explosive material comprising one or more materials selected from a group of materials consisting of amatol, baratol, octol, torpex, TNT, tetrytol, plutonium, and uranium.

5. The system of claim 1, the plurality of nanostructures comprising a plurality of nanotubes.

6. The system of claim 1, each nanostructure of the plurality of nanostructures comprising a structure selected from a group of structures consisting of a carbon nanostructure and an inorganic nanostructure.

7. The system of claim 1, the applicator comprising an applicator selected from a group of applicators consisting of a probe, a coaxial monopole applicator, a dielectric resonator, and a chamber.

8. The system of claim 1, the applicator substantially surrounding the composite.

9. The system of claim 1, further comprising one or more waveguides configured to direct the plurality of microwaves to the applicator.

10. The system of claim 9, the one or more waveguides comprising a waveguide selected from a group of waveguides consisting of a dielectric waveguide, a Goubau line, a hollow metallic waveguide, and an optical waveguide.

11. The system of claim 9, further comprising a source configured to generate the plurality of microwaves.

12. The system of claim 1, the plurality of nanostructures comprising a plurality of nanotubes, each nanotube containing a gas; and the directing the plurality of microwaves to the composite causing a plurality of atoms of the composite to fuse.

13. The system of claim 1, further comprising an explosively pumped flux compression generator configured to detonate the explosive material to generate an electromagnetic pulse.

14. A method comprising:

receiving a plurality of microwaves at an applicator;

directing, by the applicator, the plurality of microwaves to a composite, the composite comprising an explosive material and a plurality of nanostructures; and in response to the plurality of microwaves, generating, by interaction of the plurality of nanostructures with the plurality of microwaves, at least one shockwave that detonates the explosive material, wherein the plurality of nanostructures are substantially aligned and substantially dispersed throughout the composite.

15. The method of claim 14, the plurality of nanostructures making up 0.1 to 3 percent of the composite; and the explosive material making up substantially the rest of the composite.

16. The method of claim 14, the plurality of nanostructures substantially uniformly dispersed throughout the composite.

17. The method of claim 14, the explosive material comprising one or more materials selected from a group of materials consisting of amatol, baratol, octol, torpex, TNT, tetrytol, plutonium, and uranium.

18. The method of claim 14, the applicator comprising an applicator selected from a group of applicators consisting of a probe, a coaxial monopole applicator, a dielectric resonator, and a chamber.

19. The method of claim 14, the applicator substantially surrounding the composite.

20. The method of claim 14, the receiving a plurality of microwaves at an applicator comprising receiving the microwaves from one or more waveguides.

21. The method of claim 20, the one or more waveguides comprising a waveguide selected from a group of waveguides consisting of a dielectric waveguide, a Goubau line, a hollow metallic waveguide, and an optical waveguide.

22. The method of claim 14, the receiving a plurality of microwaves at an applicator comprising receiving the microwaves from a microwave source.

23. The method of claim 14:

the plurality of nanostructures comprising a plurality of nanotubes, each nanotube containing a gas; and the directing the plurality of microwaves to the composite causing a plurality of atoms of the composite to fuse.

24. The method of claim 14, further comprising detonating the explosive material in an explosively pumped flux compression generator.

* * * * *